United States Patent [19]

Vanden Broek

[11] 3,956,776

[45] May 18, 1976

[54] LIQUID WASTE MATERIAL CONVEYING SYSTEM FOR TOILETS AND THE LIKE

[75] Inventor: Christiaan J. H. Vanden Broek, Ann Arbor, Mich.

[73] Assignee: Thetford Corporation, Ann Arbor, Mich.

[22] Filed: May 28, 1975

[21] Appl. No.: 581,496

[52] U.S. Cl. ..... 4/10; 4/77; 137/236; 210/259

[51] Int. Cl.[2] ..... E03D 11/02; E03D 11/00; B60R 16/04

[58] Field of Search ..... 4/10, 41, 19, 96, 82, 4/76, 75, 79, 89, 77; 210/259, 15; 302/15, 14; 137/236, 205, 12

[56] References Cited

UNITED STATES PATENTS

| | | | |
|---|---|---|---|
| 3,115,148 | 12/1963 | Liljendahl | 137/205 |
| 3,239,849 | 3/1966 | Liljendahl | 4/77 |
| 3,318,248 | 5/1967 | Rembold | 4/10 X |
| 3,336,767 | 8/1967 | Mackenzie et al. | 137/205 X |
| 3,528,462 | 9/1970 | Quase | 137/236 X |
| 3,538,517 | 11/1970 | Cornish et al. | 4/10 |
| 3,590,836 | 7/1971 | Kuntza et al. | 137/12 |
| 3,628,194 | 12/1971 | Liljendahl | 4/10 |
| 3,730,884 | 5/1973 | Burn et al. | 210/15 |
| 3,897,600 | 8/1975 | Burholder | 4/10 |

*Primary Examiner*—Henry K. Artis
*Attorney, Agent, or Firm*—Olsen and Stephenson

[57] ABSTRACT

Apparatus for pneumatically conveying liquid waste material from a toilet or other receptacle to a receiving tank. A surge tank is located between the toilet and the receiving tank, and a vacuum pump is utilized to create a pressure drop in the surge tank sufficient only to the extent necessary to transfer the liquid waste material from the toilet to the surge tank, a ball float serves to close communication between the surge tank and the receiving tank when a partial vacuum exists in the surge tank. After a preselected time period has elapsed, the surge tank is vented to atmosphere to allow the ball float to move to an open position to discharge the liquid waste material from the surge tank to the receiving tank. Normally, ball float is the only movable element exposed to contact by the liquid waste material during the flush operation, and is a sphere that is self-cleaning in operation. If the ball float fails to seat properly, the flush cycle will automatically repeat until the ball float is clean and seats properly.

12 Claims, 2 Drawing Figures

LIQUID WASTE MATERIAL CONVEYING SYSTEM FOR TOILETS AND THE LIKE

BACKGROUND OF THE INVENTION

The present invention relates to a pneumatic liquid waste material conveying system, primarily, but not exclusively, adapted for use as a toilet flush system.

It is known in the prior art to use vacuum systems in connection with toilets to carry out the flushing operation. These systems have worked effectively, but they have not been entirely satisfactory. Because of the complex nature of some of these systems with respect to the number of movable components and the like, they are not fail-safe in operation and they are also relatively expensive to install and to maintain. Also, the energy requirements for operating the systems have been rather high so as to further increase the cost of using these systems.

SUMMARY OF THE INVENTION

The present invention has overcome the inadequacies of the prior art and provides a liquid waste material conveying system which is characterized by its relatively low installation and operating costs, and its trouble-free operation. In the present invention a vacuum pump is utilized which pulls only the degree of vacuum necessary to transfer the liquid waste material, and the vacuum pump is one requiring only a relative small source of energy for its operation. The transfer conduit for the liquid waste material is completely free of pump vanes or other valving associated with conventional systems so that the system and the pump cannot clog. If any clogging should occur with respect to the only valve in flow passageways for the waste material, the system functions to recycle itself until the valve is properly cleaned and seats itself so that the valve in effect is fail-safe.

According to one form of the present invention, a pneumatic conveying system for liquid waste material is provided that comprises a flush toilet receptacle for receiving the liquid waste material, a receiving tank to which the liquid waste material is to be transferred and in which liquid material will be maintained at a normal level, and a vacuum transfer apparatus for intermittently transferring liquid waste material from the receptacle to the receiving tank. The vacuum transfer apparatus comprises a surge tank mounted above the receiving tank and having a discharge port in its bottom wall located above the normal level of liquid waste material in the receiving tank. A lift conduit surrounds the discharge port and extends downwardly into the receiving tank a distance sufficient to have its open lower end below the lower level of liquid waste material in the receiving tank. A ball float is located in the lift conduit for floating on the surface of liquid waste material therein and is of a diameter sufficient to close the discharge port when the float is elevated into engagement therewith. A suction conduit provides communication between the receptacle and the surge tank. A vacuum pump is provided to provide a desired partial vacuum or pressure drop in the surge tank. Electrically operated control means are provided that include a conduit extending between the vacuum pump and the surge tank and having therein solenoid valve means operable for movement to a first position to open the conduit to atmosphere for venting the surge tank and to interrupt communication between the vacuum pump and the surge tank. The valve means is operable for movement to a second position to discontinue venting the surge tank and to provide communication between the vacuum pump and the surge tank for inducing the pressure drop therein. A suitable actuator, such as a flush sensing switch means is operable to close an electric circuit to energize the solenoid valve means for movement to the second position to create the pressure drop in the surge tank for flush purposes, and a primary time delaying means is associated therewith and is operable to time-in after the flush sensing switch means is closed to keep the solenoid valve means energized for a preselected time interval sufficient to carry out the flushing operation.

When the pressure drop occurs in the surge tank, the liquid waste material in the lift conduit will be elevated because of the pressure drop, and the ball float will then seat on the discharge port of the surge tank so that the waste material can be transferred from the toilet receptacle to the surge tank. After the time delay, the surge tank will be vented automatically by the solenoid valve means, and the ball float will then drop in response to the increase in pressure in the surge tank, and the waste material within the surge tank can then descend into the receiving tank.

The present invention also includes an automatic recycling feature so that if the ball float should not seat properly over the discharge port of the surge tank, and the liquid waste material in the lift conduit should then be elevated into the surge tank, a liquid level sensing means is located in the surge tank which will open the circuit to the solenoid actuated valve means causing venting of the surge tank to allow the contents of the surge tank to be discharged into the receiving tank. Controls are provided so that this feature will continue thereby ultimately cleaning the ball float and assuring proper seating so that the flush cycle can be carried out properly.

Thus, it is an object of the present invention to provide an improved pneumatic conveying system for handling liquid waste materials, and particularly to provide such a conveying system for use in conjunction with flush toilets.

Other objects of this invention will appear in the following description and appended claims, reference being had to the accompanying drawing forming a part of this specification wherein like reference characters designate corresponding parts in the several views.

DESCRIPTION OF THE PREFERRED EMBODIMENT

Figure 1:
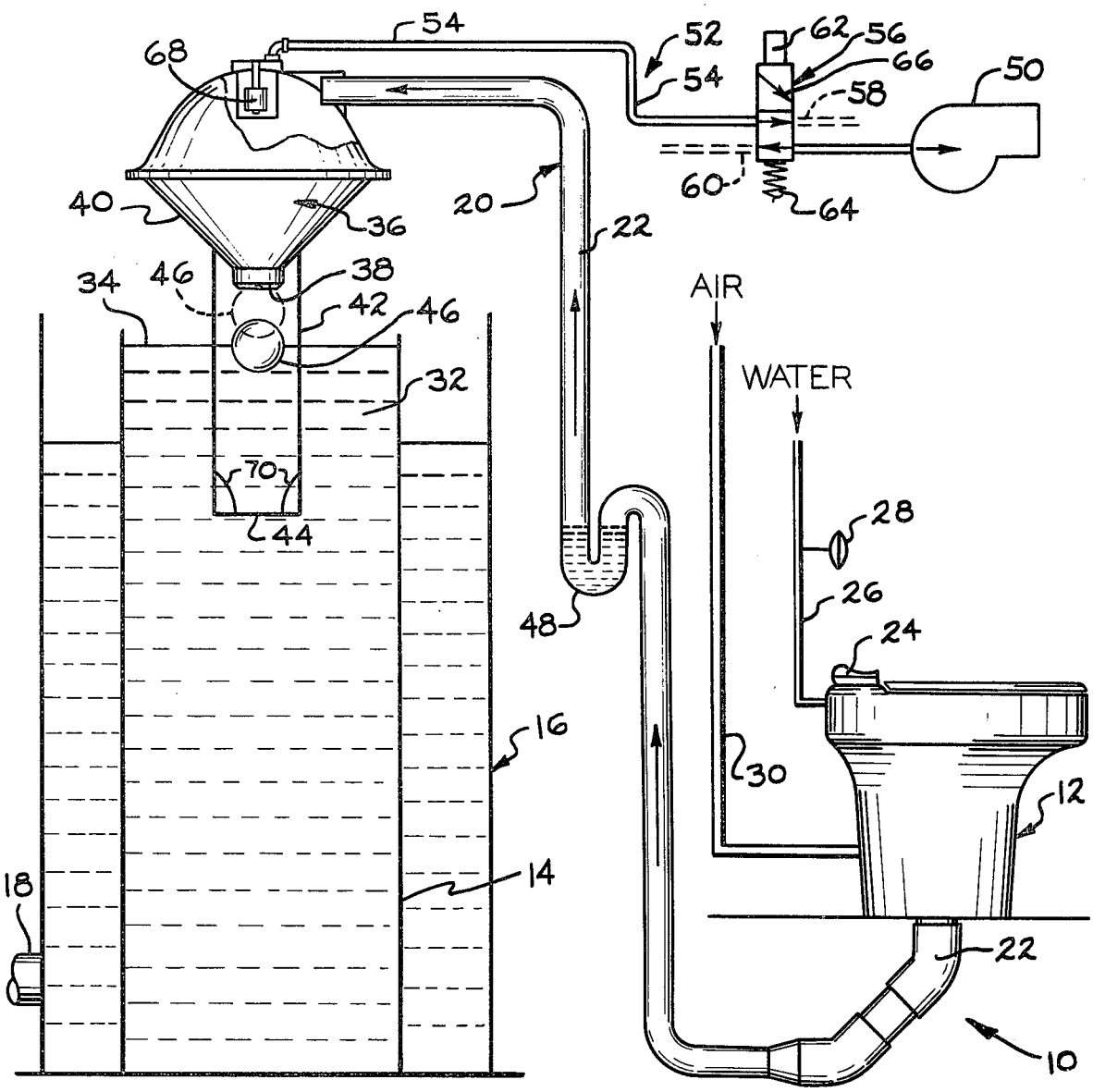
FIG. 1 is a schematic illustration of a pneumatic conveying system embodying the present invention.

Before explaining the present invention in detail, it is to be understood that the invention is not limited in its application to the details of construction and arrangement of parts illustrated in the accompanying drawing, since the invention is capable of other embodiments and of being practiced or carried out in various ways. Also, it is to be understood that the phraseology or terminology employed herein is for the purpose of description and not of limitation.

Referring now to the drawing, the invention will be described in greater detail. The pneumatic conveying system 10 includes the receptacle 12, which may be in the form of a toilet as shown, into which liquid waste material may be deposited; a receiving tank 14 which may be a component of any waste receiving apparatus such as the illustrated waste treatment tank 16 that has a discharge conduit 18; and the waste transfer apparatus 20 which is disposed between the toilet receptacle 12 and the receiving tank 14 for intermittently transferring the liquid waste material from the former to the latter.

The toilet receptacle 12 can be a toilet of the type disclosed in the pending application of Miller, et al., Ser. No. 427,338, filed Dec. 21, 1973, to which reference is made for a more detailed description of the toilet receptacle. Briefly, the toilet receptacle 12 is adapted to discharge liquid waste material at the bottom thereof into the suction conduit 22 that is a part of the vacuum transfer apparatus 20. The toilet receptacle 12 has mounted thereon the flush lever 24 which opens the water inlet line 26 for flush purposes. The water flush line 26 contains the flush sensing switch means 28 which is responsive to the flow of flush water to generate or transmit a signal for a purpose to be described hereinafter. Also, the receptacle or toilet 12 may include a vent line 30 for venting the receptacle to atmosphere to aid in the vacuum transfer operation.

The receiving tank 14 is open at the top and normally is adapted to maintain the level of the liquid waste material 32 at a level 34 which is essentially the same as the top edge of the receiving tank 14 over which material can spill into the treatment tank 16.

The vacuum transfer apparatus 20 includes the surge tank 36 which has a discharge port 38 in its bottom wall 40 which is located above the normal level of liquid waste material in the receiving tank 14. A lift conduit 42 surrounds the discharge port 38 and extends downwardly into the receiving tank 14 a distance sufficient to have its open lower end 44 situated below the normal level 34 of the liquid waste material. A ball float 46 is located in the lift conduit 42 for floating on the surface of the liquid waste material confined within the lift conduit 42, and the ball float 46 has a diameter sufficient to enable it to close the discharge port 38 when the ball float is elevated by virtue of the liquid waste material rising within the lift conduit 42 to the position shown in broken lines in FIG. 1.

As previously indicated, the suction conduit 22 extends between the receptacle 12 and the surge tank 36 and has a trap 48 therein in which a plug of liquid waste material is retained. The suction conduit 22 has its discharge end located within the surge tank 36 adjacent to the top thereof. Liquid waste material can be conveyed from the receptacle 12 via the suction conduit 22 into the surge tank 36 when a sufficient pressure drop within the surge tank 36 occurs.

For the evacuation purpose a vacuum pump 50 is provided, and control means 52 associate with the vacuum pump 50 and the surge tank 36 to utilize the vacuum pump to induce a pressure drop in the surge tank for conveying liquid waste material intermittently from the receptacle 12 to the surge tank 36. The air vent 30 cooperates in this operation to aid in providing a pressure differential on the liquid waste material in suction conduit 22.

The control means 52 includes the conduit 54 in communication with the surge tank 36 and the vacuum pump 50 and valve means 56 in the conduit 54 operable in a first position shown in FIG. 1 wherein the conduit is open to atmosphere at 58 and the vacuum pump 50 has its inlet also open to atmosphere at 60 or to any part of the system wherein a vacuum or pressure drop may be desired. The valve means 56 is adapted to be moved by the solenoid 62 against the spring 64 so that the venting of the surge tank 36 via the opening at 58 is terminated and the vacuum pump 50 is placed in communication with the surge tank 36 by the port 66. Thus, when the valve means 56 is moved to its second position a pressure drop in the surge tank 36 will be induced. This will simultaneously reduce the pressure in the lift conduit 42 which is in communication with the surge tank 36 and the level of the liquid waste material 32 will rise in the lift conduit 42 until the ball float 46 seats under the discharge port 38 sealing the surge tank 36 at the bottom. The pressure drop in the surge tank 36 will then induce flow of the liquid waste material from the receptacle 12 through the suction conduit 22 for deposit within the surge tank 36.

Also forming a part of the surge tank 36 is the liquid level sensing means or switch 68 which is located adjacent to the top of the surge tank 36 but below the inlet of the conduit 54. As will be described in greater detail hereafter, the liquid level sensing switch 68 will serve to shift the valve means to its first position shown in FIG. 1 if the liquid waste material in the surge tank 36 should rise to a level higher than is desired either as a result of liquid waste material flowing from conduit 22 or as a result of the ball float 46 not seating properly on the port 38. Also forming a part of the lift conduit 42 are the radially inwardly extending flanges 70 located at the bottom thereof to prevent the ball 46 from dropping out of the lift conduit 40 in the event the level of the liquid waste material 32 should be lowered below that of the bottom edge 44.

Figure 2:
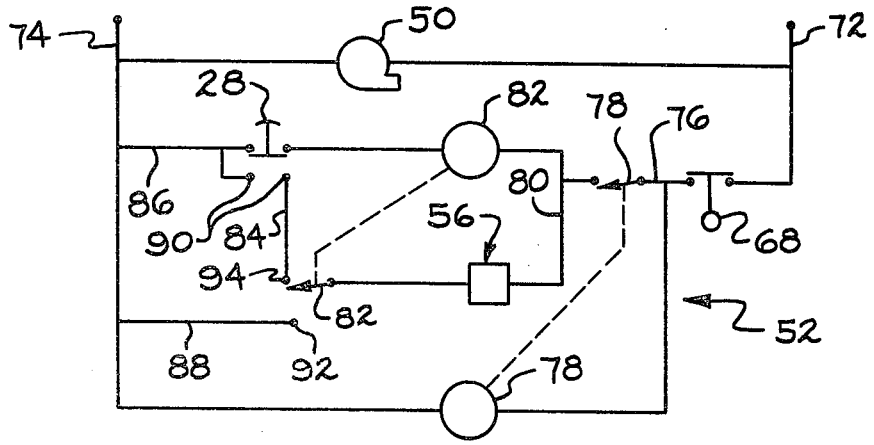
FIG. 2 is a schematic wiring diagram illustrating the control means for operating the pneumatic conveying system.

Attention is now directed to FIG. 2 for a description of other elements of the control means 52. The control means 52 are electrically operated, receiving electrical current across the conductors 72 and 74. As there shown, the vacuum pump 50 will run continuously at a relatively low rate. The solenoid operated valve means 56 is in series with the conductor 72, the liquid level sensing switch 68, conductor 76, sensing time delay means or switch 78, conductor 80, primary time delay sensing means or switch 82 and either conductor 84, the flush sensing switch means 28 and conductor 86 or in the alternative, with conductor 88. In the normal operation before a flush occurs, the time delay switches 78 and 82 are energized and have timed-out and vacuum pump 50 is running. Flushing the toilet 12 will cause the switch 28 to move to a closed position across the contacts 90 deenergizes the time delay switch 82, and after the flush is completed will cause switch element 82 to move into engagement with the contact 92. This will result in the valve means 56 remaining energized so as to hold the valve means in its second position so that the vacuum pump 50 continues to evacuate the surge tank 36 and transfer of waste material to this tank then continues. When the primary time delay switch 82 has timed-out, its switch element will return to the contact 94 and the valve means 56 will then be deenergized, and the valve means will return to the first position shown in FIG. 1 so that venting of the surge tank 36 occurs and the waste material that has been transferred thereto can then be discharged out of the port 38 which now no longer is closed by the ball float 46. This completes the normal flushing cycle.

In the event of over-load of liquid waste material in the surge tank 36 or of leakage around the ball float 46 causing liquid waste material to rise unduly in surge tank 36, liquid level sensing switch means 68 will break its contacts resulting in both primary time delay switch 82 and sensing time delay switch 78 being deenergized, valve means 56 will be deenergized to vent the surge tank 38, and the surge tank 38 will then empty resulting in the liquid level sensing switch means 68 again making contact. The sensing time delay switch 78 now starts timing and holds its switch in the position shown in FIG. 2 which energizes primary time delay switch 82 and the flushing cycle repeats itself. This operation will continue to repeat itself, if for example the ball float 46 has an obstruction on it which prevents it from making an effective contact with the discharge port 38, until such time as the ball has cleaned itself resulting from the flow of the liquid waste material in and out of the surge tank 36 over the surface of the ball float 36. Thus, the only valve or moving part in the flow circuit of the liquid waste material is failsafe. The liquid waste material transfer cycle repeats itself until the ball float seals, and the ball is in effect self-cleaning in the system.

It is claimed:

1. A pneumatic conveying system that comprises a receptacle for receiving liquid waste material, a receiving tank to which the liquid waste material is to be transferred and in which liquid material will be maintained at a normal level, and vacuum transfer apparatus for intermittently transferring liquid waste material from said receptacle to said receiving tank, said vacuum transfer apparatus comprising a surge tank mounted above said receiving tank and having a discharge port in its bottom wall located above the normal level of liquid waste material in said receiving tank, a lift conduit surrounding said discharge port and extending downward into said receiving tank a distance sufficient to have its open lower end below said normal level of liquid waste material, a ball float in said lift conduit for floating on the surface of liquid waste material and of a diameter sufficient to close said discharge port when the float is elevated into engagement therewith, a suction conduit providing communication between said receptacle and said surge tank, a vacuum pump, and control means associated with said vacuum pump and said surge tank and operable to utilize the vacuum pump to induce a pressure drop in the surge tank and thereby in the lift conduit in response to a signal generated at said receptacle so that the liquid waste material in said lift conduit rises pneumatically and positions said ball float in a sealing relation under said discharge port and thereafter liquid waste material can be transferred pneumatically from said receptacle to said surge tank for subsequent deposit in said receiving tank.

2. The pneumatic conveying system that is defined in claim 1, wherein said control means includes primary time delay means for maintaining the pressure drop in the surge tank for a preselected time interval, said control means including vent means operable to vent said surge tank to atmosphere at the expiration of said time interval so that said ball float will be released from said port.

3. The pneumatic conveying system that is defined in claim 1, wherein said control means includes vent means operable to vent said surge tank to atmosphere and liquid level sensing means in said surge tank for sensing a high level of liquid therein, said vent means being responsive to a signal from said sensing means to vent said surge tank to atmosphere.

4. The pneumatic conveying system that is defined in claim 3, wherein said sensing means includes a sensing time delay means for maintaining said vent means in venting relation to said surge tank after receiving said signal for a preselected time interval sufficient for discharging liquid waste material from said surge tank to said receiving tank.

5. The pneumatic conveying system that is defined in claim 4, wherein said control means includes a primary time delay means operable after said sensing time delay means has timed out for initiating the utilization of said vacuum pump for reducing pressure in said surge tank for a preselected time interval.

6. The pneumatic conveying system that is defined in claim 1, wherein said control means includes a conduit in communication with said surge tank and with said vacuum pump, and valve means in said conduit operable in a first position to open said conduit to atmosphere and to interrupt communication between said vacuum pump and said surge tank, said valve means being operable in a second position to discontinue venting the surge tank to atmosphere and to provide communication between said vacuum pump and said surge tank for inducing a pressure drop in the latter.

7. The pneumatic conveying system that is defined in claim 6, wherein said valve means is normally on said first position and is movable to said second position in response to flow of energy from an independent source, and said control means includes primary time delay means to maintain said flow of energy to said valve means a preselected period of time after said signal has terminated.

8. The pneumatic conveying system that is defined in claim 7, wherein said control means includes sensing switch means for interrupting said flow of energy in the event liquid waste material rises above a preselected level in said surge tank.

9. The pneumatic conveying system that is defined in claim 8, wherein said control means includes a sensing time delay means for continuing to interrupt flow of energy to said valve means and to said primary time delay means for a preselected time period for venting of said surge tank.

10. The pneumatic conveying system that is defined in claim 9, wherein said receptacle is a toilet having a source of water for flush purposes and said signal is generated by the actuation of a flush sensing switch means responsive to the flow of flush water, said flush sensing switch means being part of said control means.

11. A pneumatic conveying system that comprises a flush toilet receptacle for receiving liquid waste material, a receiving tank to which the liquid waste material is to be transferred and in which liquid material will be maintained at a normal level, and vacuum transfer apparatus for intermittently transferring liquid waste material from said receptacle to said receiving tank, said vacuum transfer apparatus comprising a surge tank mounted above said receiving tank and having a discharge port in its bottom wall located above the normal level of liquid waste material in said receiving tank, a lift conduit surrounding said discharge port and extending downward into said receiving tank a distance sufficient to have its open lower end below said normal level of liquid waste material, a ball float in said lift conduit for floating on the surface of liquid waste material and of a diameter sufficient to close said discharge port when the float is elevated into engagement therewith, a suction conduit providing communication between said receptacle and said surge tank, a vacuum pump, and electrically operated control means including a conduit extending between said vacuum pump and said surge tank and having therein solenoid valve means operable for movement to a first position to open said conduit to atmosphere for venting said surge tank and to interrupt communication between said vacuum pump and said surge tank and operable for movement to a second position to discontinue venting said surge tank and to provide communication between said vacuum pump and said surge tank for inducing a pressure drop in said surge tank, flush sensing switch means operable to close an electric circuit to energize said solenoid valve means for movement to said second position and primary time delay means operable to time-in after said flush sensing switch means is closed for keeping said solenoid valve means energized for a preselected time interval.

12. The pneumatic conveying system that is defined in claim 11, wherein said electrically operated control means includes a normally closed liquid level sensing switch in said surge tank adapted to be opened in the event the liquid waste material therein rises above a preselected level, said liquid level sensing switch being in a circuit with said solenoid valve means so that when said liquid level sensing switch is moved to an open position said solenoid valve means will be deenergized for movement to said first position to vent said surge tank, and sensing time delay means responsive to opening of said liquid level sensing switch to keep said solenoid valve means deenergized for a preselected time period sufficient to allow discharge of the contents of said surge tank to said receiving tank.

* * * * *